US005703559A

United States Patent [19]

Emmerich et al.

[11] Patent Number: 5,703,559

[45] Date of Patent: Dec. 30, 1997

[54] PLATE PACKET FOR MAGNET CORES FOR USE IN INDUCTIVE COMPONENTS HAVING A LONGITUDINAL OPENING

[75] Inventors: Kurt Emmerich, Alzenau; Herbert Hein, Freigericht, both of Germany

[73] Assignee: Vacuumschmelze GmbH, Hanau, Germany

[21] Appl. No.: 711,094

[22] Filed: Sep. 9, 1996

[30] Foreign Application Priority Data

Sep. 9, 1995 [DE] Germany ..... 295 14 508.0

[51] Int. Cl.[6] ..... H01F 27/28; H01F 27/24

[52] U.S. Cl. ..... 336/234; 336/210; 336/212

[58] Field of Search ..... 336/200, 234, 336/216, 210, 212

[56] References Cited

U.S. PATENT DOCUMENTS 2,664,541 12/1953 Henderson ..... 336/212

5,155,676 10/1992 Spreen ..... 336/212

FOREIGN PATENT DOCUMENTS 2129622 5/1984 United Kingdom ..... 336/210

*Primary Examiner*—Michael L. Gellner

*Assistant Examiner*—Anh Mai

*Attorney, Agent, or Firm*—Hill, Steadman & Simpson

[57] ABSTRACT

For the production of a plate packet for magnet cores that have an opening in the longitudinal direction of the plate lamellae, inner plate lamellae with reduced cross-section are stacked in the region of the opening. Of these inner lamellae, at least two lie in one plate plane and together have a surface that is reduced in size by the cross-section of the opening in comparison to the size of the outer plate lamellae.

11 Claims, 1 Drawing Sheet

9
7
9

9
6

8
6
4
5
2
1
3

PLATE PACKET FOR MAGNET CORES FOR USE IN INDUCTIVE COMPONENTS HAVING A LONGITUDINAL OPENING

BACKGROUND OF THE INVENTION

1. Field of the Invention

The invention is directed to a plate packet core assembly for magnet cores, assembled from stacked plate lamellae core laminations, for use in inductive components, such as transformers, throttle coils, positioning drives, actuators such as e.g. magnetic valves, electrical machines and other applications, in which magnetic circuits charged with an alternating field are used.

2. Description of the Prior Art

Magnet cores are known that are made of stacked plate lamellae, preferably insulated from one another, in order to reduce the eddy currents that otherwise flow in the magnet core due to alternating magnetic fields. In addition, plate packets as magnet cores have the advantage that the required windings can be pushed over the individual limb before the magnetic circuit is closed. Furthermore, in this way a smaller or larger air gap can be set easily by the choice of the dimensions of the plate packet. Plate packets of this sort are formed from individual plate lamellae which are bolted together or glued together. Bolting the lamellae together, however, has the disadvantage that eddy currents can arise in the bolts, so that non-conducting material should preferably be used.

In addition, it is known from European application 0133 858 to assemble a plate packet of this sort from individual plate lamellae that have projections on one side and recesses or bores on the other side in registry with the projections. By this means, the plate packets can be produced by simply pressing the plates together. Above all, in this type of manufacture each plate lamella can be immediately connected with the plate lamellae previously put together during the stacking process, and thus fixed in position.

In many cases it is desirable, e.g. for fastening elements or for setting elements, e.g. for setting an air gap, to provide openings in the plate packets that run in the direction of the plane of the plates, i.e. the plane of the individually stacked plate lamellae. This normally requires a routing or boring, but the insulation of the individual plates from one another can be impaired at least at the edge of the opening that arises in this way. Moreover, this metal cutting processing requires considerable costs.

SUMMARY OF THE INVENTION

It is an object of the present invention to provide a plate packet with at least one opening in the plate plane, without additional costs arising for the manufacture of the opening, and without impairment of the insulation of the plates from one another.

According to the invention, this object is achieved in a lamellae packet wherein, for forming an opening running in the direction of the plane of the plate lamellae (plate plane), in the region of this opening between outer plate lamellae (whose surface corresponds to the cross-section of the plate packet in the plate plane) several inner plate lamellae with reduced surface dimensions are arranged in one plate plane. The surface of these inner lamellae in combination together corresponds to the cross-section of the overall plate packet without the opening.

It is particularly advantageous to use several inner plate lamellae with reduced surface dimensions in one plate plane for the formation of an opening if the above-described known method for stacking the plates with projections and recesses or bores is used. This permits the plates, and also the inner plates, to be supplied and stacked mechanically, and to be connected with the already-produced partial plate packet by being pressed thereon. For secure fastening of the plates to one another, however, it is necessary to provide for each plate a number of projections or recesses such that each inner plate lamella with reduced cross-section has either at least two projections and recesses or bores or, if only one projection and recess is provided, this plate lamella is constructed with a non-circular cross-section.

If a rectangular opening is provided, it is sufficient to use inner plate lamellae with a reduced cross-section each having the same dimensions. If round or oval openings are used, the dimension of the surfaces of successive inner plate lamellae with reduced cross-section must change from plate plane to plate plane in a manner corresponding to the desired shape of the opening.

DESCRIPTION OF THE PREFERRED EMBODIMENTS

Figures 1, 2A, 2B, 2C:
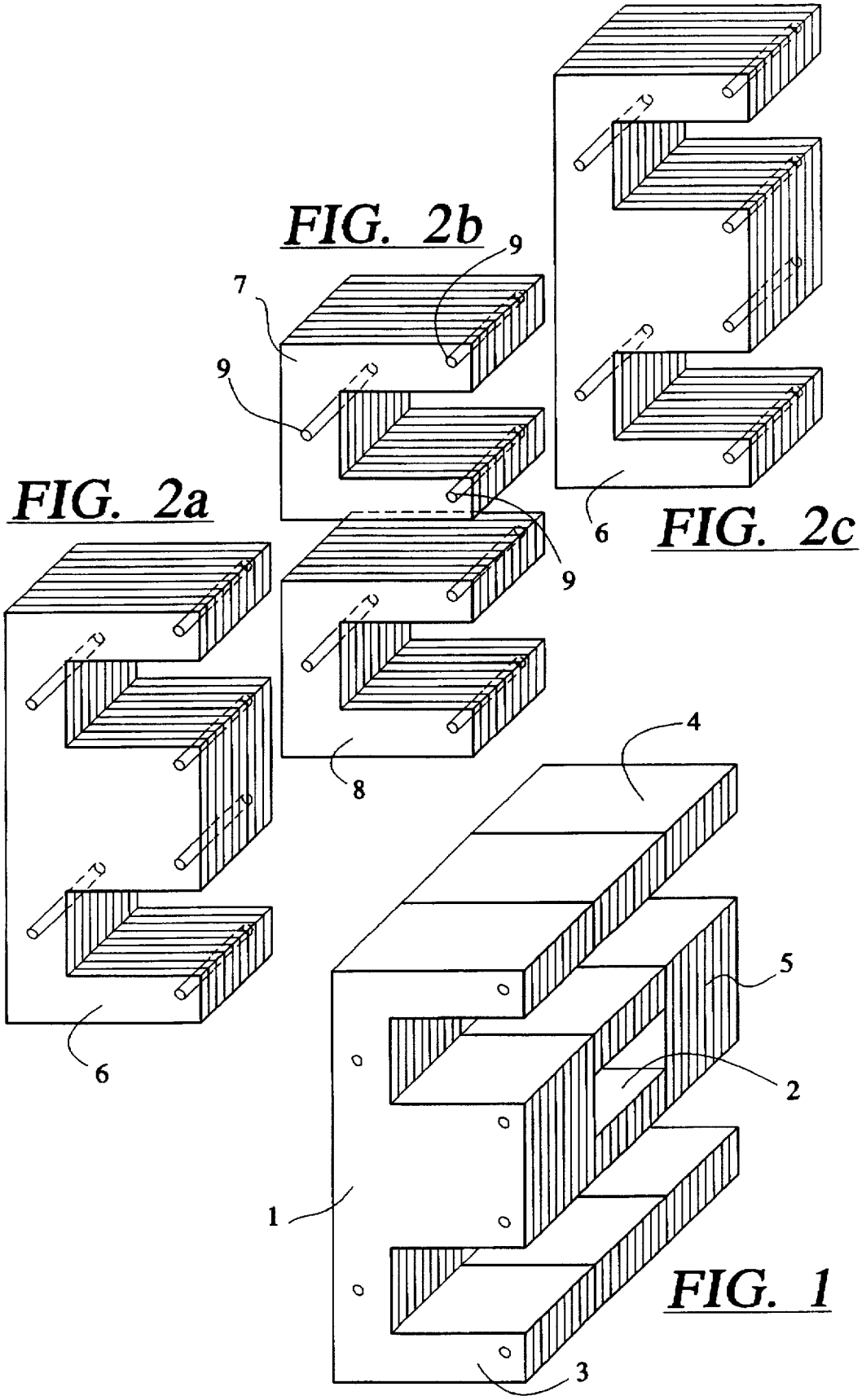
FIG. 1 is a perspective view of a plate packet (core assembly) constructed in accordance with the principles of the present invention.
FIGS. 2*a*, 2*b* and 2*c*, in combination, show a partially exploded view of the assembly of FIG. 1.

In FIG. 1, the plate packet 1 has an E-shaped cross-section and an inner opening 2 with a rectangular cross-section that can serve to receive fastening bolts or setting pins of widely varying types. For use as an actuator in a valve, the opening can, for example, be used as a leadthrough for the valve stem guide.

The plate packet 1 has an outer limb 3, a further outer limb 4 and a middle limb 5, in which the opening 2 is located. The size of the surface of the outer plate lamellae 6 are shown in FIGS. 2*a* and 2*c*, while FIG. 2*b* shows the inner plate lamellae 7 and 8, respectively having a U-shaped cross-section. The U-shaped cross-section of the inner plate lamellae 7 and 8 is chosen so that a plate lamella 7 and a plate lamella 8 each have a surface whose area is smaller than the areas that cover the outer plate lamellae 6 by an amount equal to the area of the opening 2.

In the exemplary embodiment, the stacking technique is applied with the help of projections and recesses. For the secure fastening of the plate lamellae to one another, three projections and recesses 9 are provided for each inner plate lamella, and, correspondingly, six projections and recesses 9 are respectively arranged on the outer plate lamellae 6. For the manufacture of the plate packet 1 it is thus required first to stack outer plate lamellae 6, each having an E-shaped cross-section, over one another, and then to supply the respective two inner plate lamellae 7 and 8 to the stack in one plate plane, and finally again to apply outer plate lamellae 6 having an E-shaped cross-section.

Although modifications and changes may be suggested by those skilled in the art, it is the intention of the inventors to embody within the patent warranted hereon all changes and modifications as reasonably and properly come within the scope of their contribution to the art.

We claim as our invention:

1. A plate packet for a magnetic core for charging a magnetic circuit with an alternating field, comprising:

a plurality of plate lamellae disposed in a stacked assembly respectively in a plurality of parallel, adjacent plate planes;

said plurality of plate lamellae including first and second sets of outer plate lamellae each having the same cross-section in said plate planes; and at least two sets of inner plate lamellae disposed between said first and second sets of outer plate lamellae, said at least two sets of inner plate lamellae being spaced from each other and forming an opening in said plate planes between said first and second sets of outer lamellae, said at least two sets of inner plate lamellae, in combination, having a cross-section which, except for said opening, is the same as the cross-section of said first and second sets of outer lamellae.

2. A plate packet as claimed in claim 1 wherein each of the plate lamellae in each of said at least two sets of inner plate lamellae has a projection on one side thereof parallel to said plate planes and a projection-receiving opening, in registry with said projection, on an opposite side thereof parallel to said plate planes for holding the plate lamellae in each of said at least two sets of inner plate lamellae in registry with each other when pressed together in said stacked assembly, and wherein each of the plate lamellae in each of said first and second sets of outer plate lamellae has a plurality of projections on one side thereof parallel to said plate planes and a plurality of projection-receiving openings on an opposite side thereof parallel to said plate planes, said projections and projection-receiving openings on said plate lamellae in said first and second sets of outer plate lamellae being in registry with the projections and projection-receiving openings on said plate lamellae in each of said at least two sets of inner plate lamellae. For holding said first and second sets of outer plate lamellae in registry with said at least two sets of inner plate lamellae when pressed together in said stacked assembly.

3. A plate packet as claimed in claim 1 wherein each of the plate lamellae in each of said first and second sets of outer plate lamellae and each of said at least two sets of inner plate lamellae has at least one projection on one side thereof parallel to said plate planes and at least one projection-receiving opening in an opposite side thereof parallel to said plate planes, all of said projections and all of said projection-receiving openings being in registry and having a non-circular cross-section.

4. A plate packet as claimed in claim 1 wherein each of the plate lamellae in said at least two sets of inner plate lamellae has a same surface size for forming a rectangular opening.

5. A plate packet as claimed in claim 1 wherein the plate lamellae in said at least two sets of inner plate lamellae respectively have increasing surface sizes, proceeding from one of said sets of outer plate lamellae to the other set of outer plate lamellae, for producing a non-rectangular opening.

6. A plate packet as claimed in claim 1 comprising a plurality of alternating sets of inner plate lamellae and outer plate lamellae for producing a plurality of openings between each set of inner plate lamellae.

7. A plate packet as claimed in claim 1 wherein a number of sets of inner plate lamellae is twice a number of openings between said sets of inner plate lamellae.

8. A plate packet as claimed in claim 1 wherein said opening is adapted for receiving a fastening element.

9. A plate packet as claimed in claim 1 wherein said opening is adapted for receiving a setting element.

10. A plate packet as claimed in claim 1 comprising two of said sets of inner plate lamellae, each having a U-shaped cross-section, and wherein each of said first and second sets of outer plate lamellae has an E-shaped cross-section.

11. A plate packet as claimed in claim 10 wherein each of the plate lamellae in each of said two sets of inner plate lamellae has three projections on one side thereof parallel to said plate planes and three projection-receiving openings on an opposite side thereof parallel to said plate planes, said three projections on said inner plate lamellae being respectively in registry with said three projection-receiving openings on said inner plate lamellae for holding said inner plate lamellae in registry with each other when pressed together in said stacked assembly, and wherein each of the plate lamellae in each of said first and second sets of outer plate lamellae has six projections on one side thereof parallel to said plate planes and six projection-receiving openings on an opposite side thereof parallel to said plate planes, said six projections and said six projection-receiving openings on said plate lamellae of said first and second sets of outer lamellae respectively being in registry with said projections and projection-receiving openings on said plate lamellae of said two sets of inner plate lamellae for holding said first and second sets of outer plate lamellae in registry relative to said two sets of inner plate lamellae when said first and second sets of outer plate lamellae and said two sets of inner plate lamellae are pressed together in said stacked assembly.

* * * * *